US006071149A

United States Patent [19]

Hara

[11] Patent Number: 6,071,149

[45] Date of Patent: Jun. 6, 2000

[54] ELECTRICAL CARD CONNECTOR

[75] Inventor: Tomohisa Hara, Nagono, Japan

[73] Assignee: Hon Hai Precision Ind. Co., Ltd., Taipei Hsien, Taiwan

[21] Appl. No.: 09/387,194

[22] Filed: Aug. 31, 1999

[30] Foreign Application Priority Data

Nov. 24, 1998 [TW] Taiwan ..... 87219531

[51] Int. Cl.[7] ..... H01R 13/635

[52] U.S. Cl. ..... 439/607; 439/159; 439/541.5

[58] Field of Search ..... 439/64, 607, 609, 439/79, 159, 160, 540.1, 541.5

[56] References Cited

U.S. PATENT DOCUMENTS

| | | | |
|---|---|---|---|
| 5,275,573 | 1/1994 | McCleerey | 439/159 |
| 5,383,789 | 1/1995 | Watanabe | 439/159 |
| 5,451,168 | 9/1995 | Shuey | 439/159 |
| 5,490,791 | 2/1996 | Yamada et al. | 439/541.5 |
| 5,643,001 | 7/1997 | Kaufman et al. | 439/541.5 |
| 5,778,521 | 7/1998 | Law et al. | 439/159 |
| 5,795,190 | 8/1998 | Ono | 439/607 |
| 5,967,845 | 10/1999 | Ho et al. | 439/64 |

*Primary Examiner*—Gary F. Paumen
*Attorney, Agent, or Firm*—Wei Te Chung

[57] ABSTRACT

A stacked electrical card connector comprises a shielding housing including upper and lower shields, a pair of headers and a pair of card ejection mechanisms. The shields are formed by a stamping process. A pair of flanges is formed on opposite side surfaces of each shield. A hook is formed at an end of one of the flanges of each shield for engaging with a corresponding flange of the other shield thereby engaging the shields together. Alternatively, the shields are integrally formed together. A receiving space is formed in each shield by the flanges for receiving an electrical card therein. A pair of clips extends from opposite sides of the shield for attaching the shield to the header by bolts and nuts. The card ejection mechanisms are directly mounted to a longitudinal side wall of the corresponding shield.

9 Claims, 10 Drawing Sheets

ELECTRICAL CARD CONNECTOR

BACKGROUND OF THE INVENTION

The present invention relates to an electrical card connector, and particularly to a stacked electrical card connector having a combined shielding housing for receiving two electrical cards.

As the popularity of notebook computers increases, electrical cards are becoming more common for increasing storage capacity and processing speed of stored data. Thus, electrical card connectors are commonly used to connect a peripheral device to the computer. Most current electrical cards and electrical card connectors conform to the standards of PCMCIA (Personal Computer Memory Card International Association).

A prior art electrical card connector is disclosed in Taiwan Patent Application No. 85103753 and U.S. Pat. Nos. 5,275,573, 5,451,168, and 5,383,789. Referring to FIGS. 1A and 1B, the electrical card connector comprises a header 7, a frame 8 for connecting with the header 7 and a card ejection mechanism 9. The header 7 covered with a shielding plate 71 is attached to the frame 8 and defines a plurality of passageways 72 for receiving a plurality of contacts 73 therein. The card ejection mechanism 9 is mounted to an outer side of the frame 8 and comprises a push rod 91 and an ejection member 92 attached to an end of the push rod 91. Accordingly, the ejection mechanism 9 can conveniently eject an electrical card inserted in the electrical card connector. Since the connector can only receive one electrical card, the requirements of current trends in the development of personal computers cannot be met.

To meet the demand for an increase in data storage capacity of personal computers, a stacked electrical card connector, such as those disclosed in Taiwan Patent Application Nos. 83112268 and 86210606, is introduced. Referring to FIG. 2, a conventional stacked electrical card connector 6 is formed by vertically attaching two single connectors together. A pair of holes 63 is disposed at ends of upper and lower arms 61, 62 of the stacked connector 6 adjacent to a header (not labeled). The upper and lower arms 61, 62 are fastened together by a bolt (not shown) extending through each hole 63. A shielding plate 64 covers the header of the connector 6 for preventing electromagnetic interference from disrupting signal transmission. As only the header is covered by the shielding plate 64, problems arising from electromagnetic interference cannot be entirely eliminated. Furthermore, a plastic member of the ejection mechanism mounted on the conventional stacked connector not only increases the number of components and complicates the manufacturing process, but it also increases the dimension of the connector, which is unfavorable for notebook computers. Thus, an electrical card connector having a limited number of components and a reduced dimension is requisite to be in line with the present standards of PCMCIA.

BRIEF SUMMARY OF THE INVENTION

Accordingly, an object of the present invention is to provide a stacked electrical card connector having a shielding housing comprising upper and lower shields for receiving two electrical cards and providing excellent electromagnetic shielding capabilities.

To fulfill the object mentioned above, a stacked electrical card connector in accordance with a preferred embodiment of the present invention comprises a shielding housing including upper and lower shields attached together, a pair of headers positioned in the housing, and a pair of card ejection mechanisms mounted to a side surface of the shielding housing. Each ejection mechanism includes a push rod, an actuator, and an ejection plate pivotably secured together. The shields of the shielding housing are formed by stamping. A pair of flanges is formed on opposite side surfaces of each shield. A hook is formed at an end of one of the flanges of each shield for engaging with the corresponding flange of the other shield thereby engaging the shields together. Alternatively, the shields are integrally formed together. A receiving space is thereby formed in each shield by the flanges for receiving an electrical card therein. A pair of clips extends from opposite sides of the shield for attaching the shield to the header by bolts and nuts. The push rod of the card ejection mechanism comprises a push button and a guide directly mounted to a longitudinal side wall of the shield. Hence, the shielding housing provides both shielding and fixing capabilities.

Other objects, advantages and novel features of the invention will become more apparent from the following detailed description when taken in conjunction with the accompanying drawings.

DETAILED DESCRIPTION OF THE INVENTION

Figure 1A:
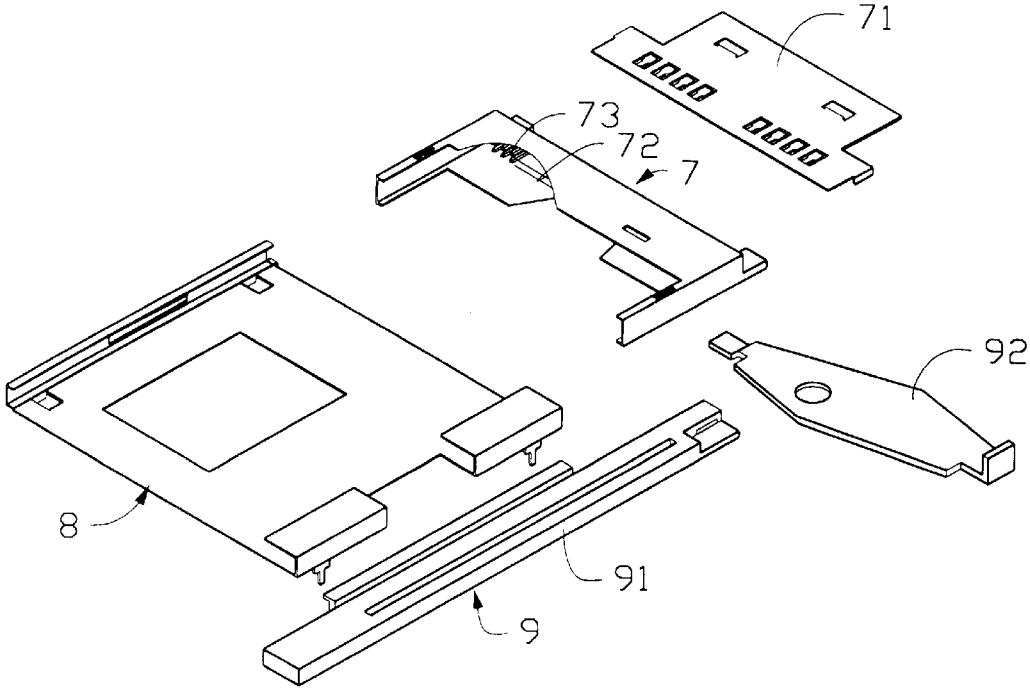
FIG. 1A (PRIOR ART)
FIG. 1A is an exploded view of a conventional electrical card connector.
Figure 1B:
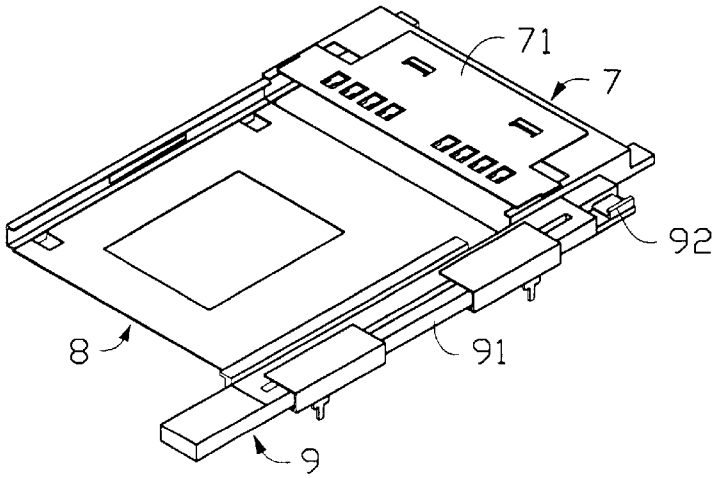
FIG. 1B (PRIOR ART)
FIG. 1B is an assembled view of FIG. 1A.
Figure 2:
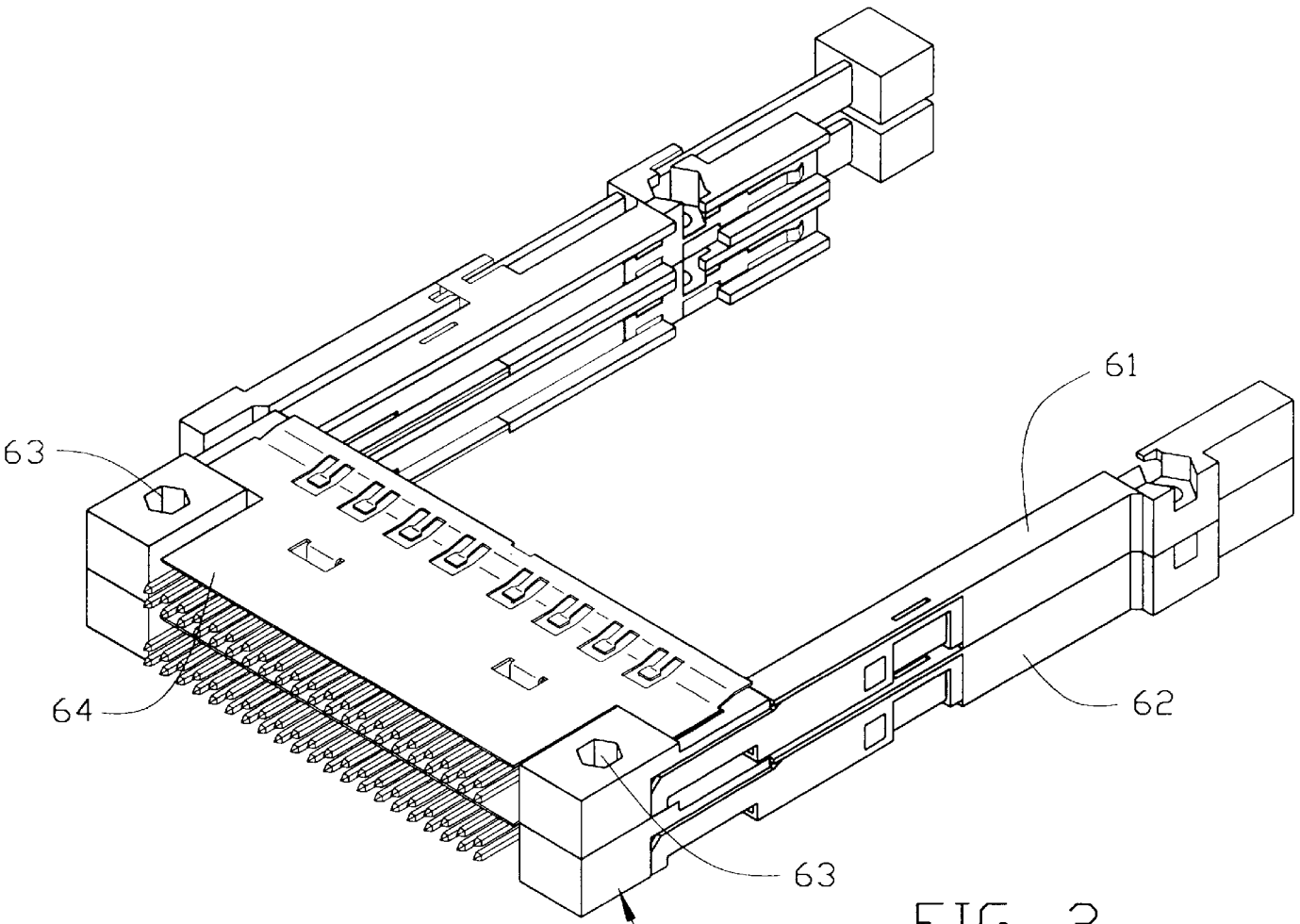
FIG. 2 (PRIOR ART)
FIG. 2 is a perspective view of a conventional stacked electrical card connector.
Figure 3:
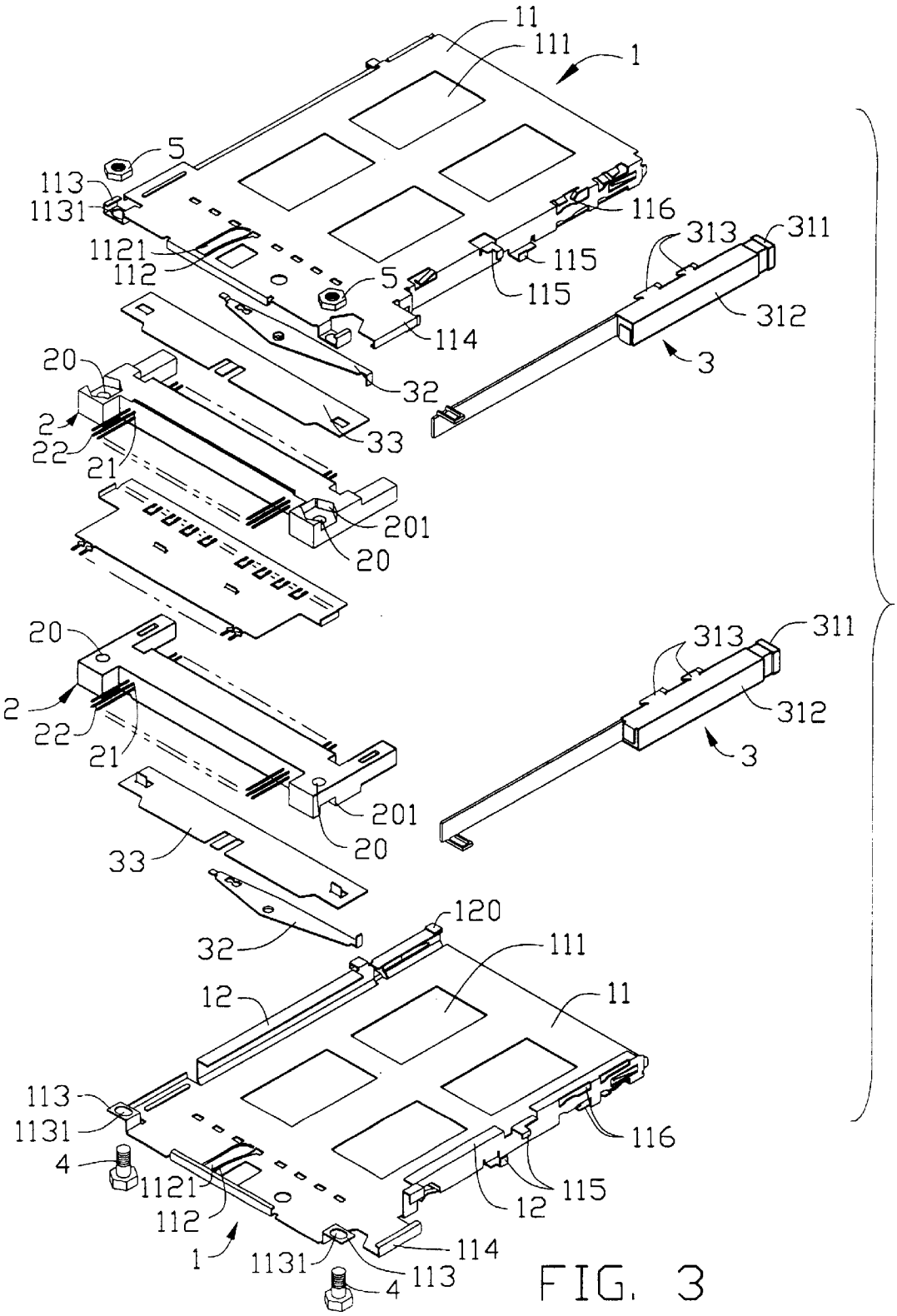
FIG. 3 is an exploded view of a stacked electrical card connector in accordance with a first embodiment of the present invention.

For facilitating understanding, like components are designated by like reference numerals throughout the various embodiments of the invention as shown in the attached drawings. Referring to FIG. 3, a stacked electrical card connector in accordance with a first embodiment of the present invention comprises a shielding housing 1, a pair of headers 2 positioned in the shielding housing 1, a pair of card ejection mechanisms 3 mounted to a side surface of the shielding housing 1, and bolts 4 and nuts 5 (FIG. 5) for interconnecting the headers 2 and the shielding housing 1.

The shielding housing 1 includes upper and lower shields 11. Since the upper and lower shields 11 have a similar structure, only one will be described in detail herein. At least one opening 111 is disposed in the shield 11 for facilitating dissipation of heat generated by an inserted electrical card. A pair of opposite flanges 12 is formed by horizontally bending top portions of longitudinal side walls of the shield 11. A hook 120 is disposed on an end of one of the flanges 12.

Figure 4A:
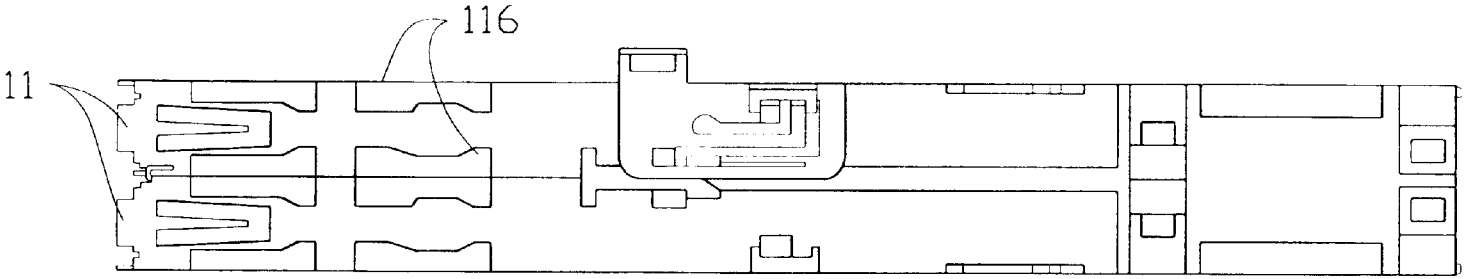
FIG. 4A is a side view of a lower shield and an upper shield assembled together.
Figure 4B:
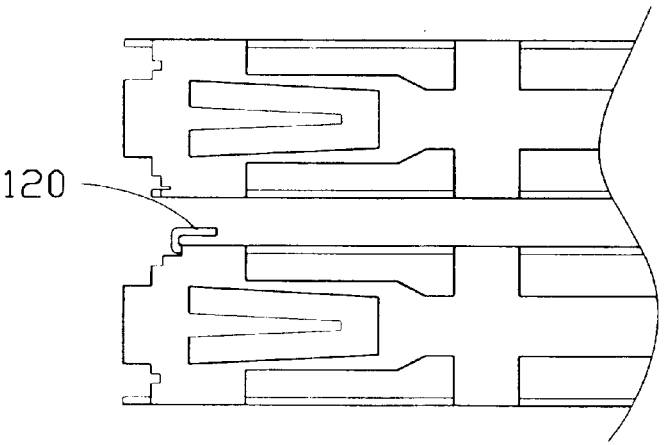
FIG. 4B is a partial, enlarged view of the shields showing a hook for assembling the shields together.
Figure 4C:
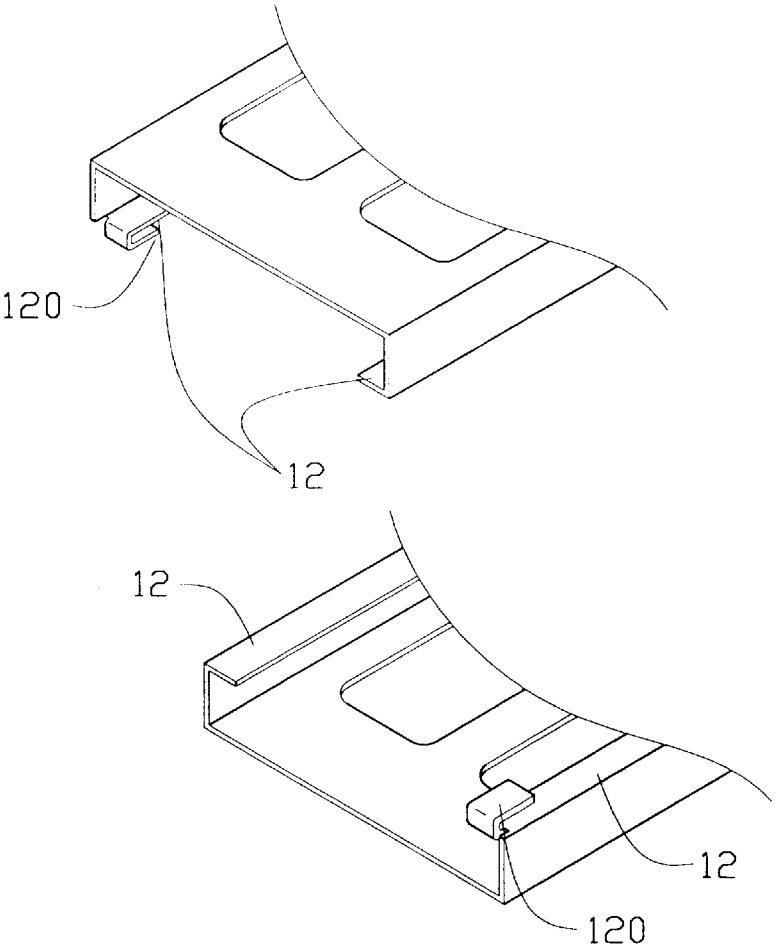
FIG. 4C is a partial, perspective view of the shields showing the hooks and flanges to be engaged together.

Referring also to FIGS. 4A, 4B and 4C, the hook 120 of one shield 11 engages with the flange 12 of the other shield 11 for assembling the upper and lower shields 11 together. A receiving space is thereby formed in each shield 11 by the flanges 12.

Figure 5:
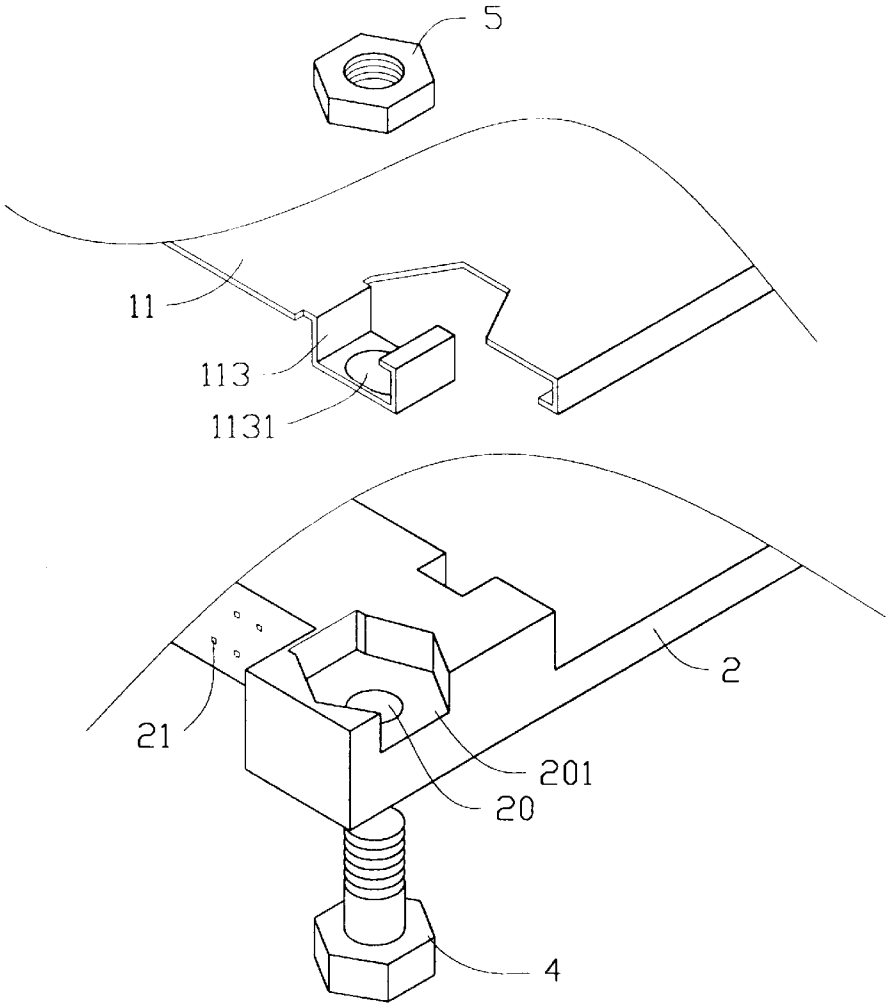
FIG. 5 is a partial, exploded view of a header, the shields, and an assembly for mounting the connector to a circuit board.

An arcuate slot 112 is disposed on the shield 11 proximate a middle portion thereof. A concave plane 1121 is formed adjacent to an edge of the arcuate slot 112 opposite the card ejection mechanism 3 for limiting movement thereof. A pair of clips 113 extends from opposite longitudinal sides of the shield 11. Each clip 113 is U-shaped as shown in FIG. 5 with an aperture 1131 disposed therein. An L-shaped tab 114 upwardly extends from a side of the shield 11 proximate the clip 113. The tab 114 has an inwardly extending top portion thereby defining a space for receiving the card ejection mechanism 3 therein. A pair of staggered fasteners 115 is formed outwardly extending from a middle portion of one of the longitudinal side walls of the shield 11 adjacent to the tab 114 for preventing vertical movement of a push rod 31 of the card ejection mechanism 3. Two pairs of locking holes 116 are disposed in an end portion of the longitudinal side wall of the shield 11 adjacent to the fastener 115.

The card ejection mechanism 3 comprises the push rod 31, an actuator 32 and an ejection plate 33 pivotably secured together. The push rod 31 further comprises a push button 311 and a guide 312 for retaining the push button 311. A pair of claws 313 extends from the guide 312 of the shield 11 for engaging with the corresponding locking holes 116 thereby mounting the card ejection mechanism 3 to the shield 11.

Also referring to FIG. 5, the header 2 defines a plurality of passageways 21 for receiving a plurality of contacts 22 (not shown) therein. A pair of screw holes 20 is disposed through opposite ends of the header 2 corresponding to the apertures 1131 of the clips 113, and a pair of cavities 201 is disposed in a top surface of the header 2 in communication with the screw holes 20 for receiving the corresponding clips 113 therein.

Figure 6:
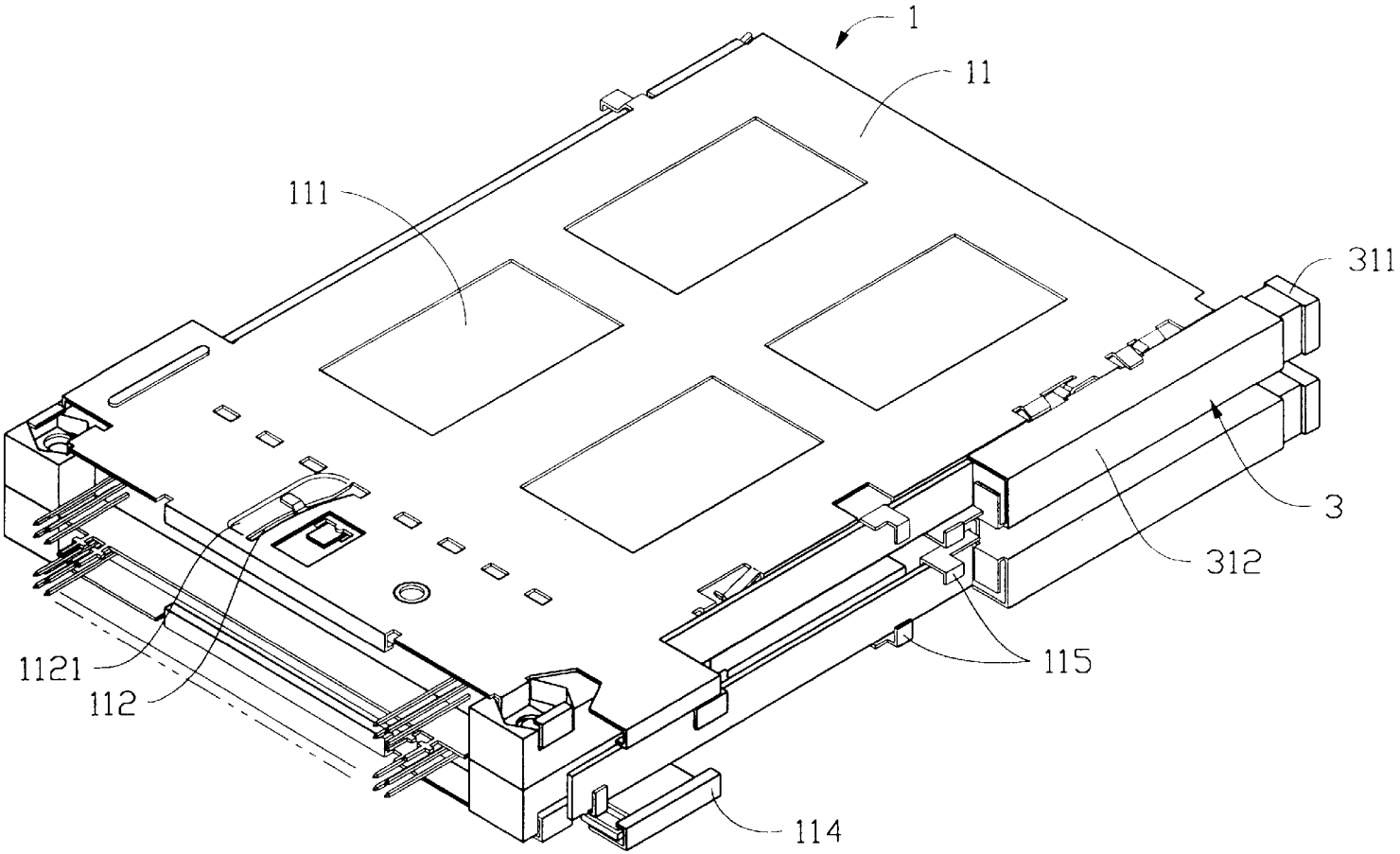
FIG. 6 is an assembled view of FIG. 3.

Referring to FIG. 6, in assembly, the two headers 2 are respectively positioned in the upper and lower shields 11 and fastened together by means of the bolts 4 and the nuts 5. The upper and lower flanges 12 are engaged with each other by means of the hooks 120 thereby preventing detachment of the shields 11. Thus, a receiving space for receiving an electrical card is defined in each of the upper and lower shields 11. The shields 11 cover the surfaces of the headers 2 thereby providing excellent shielding capabilities.

Figure 7A:
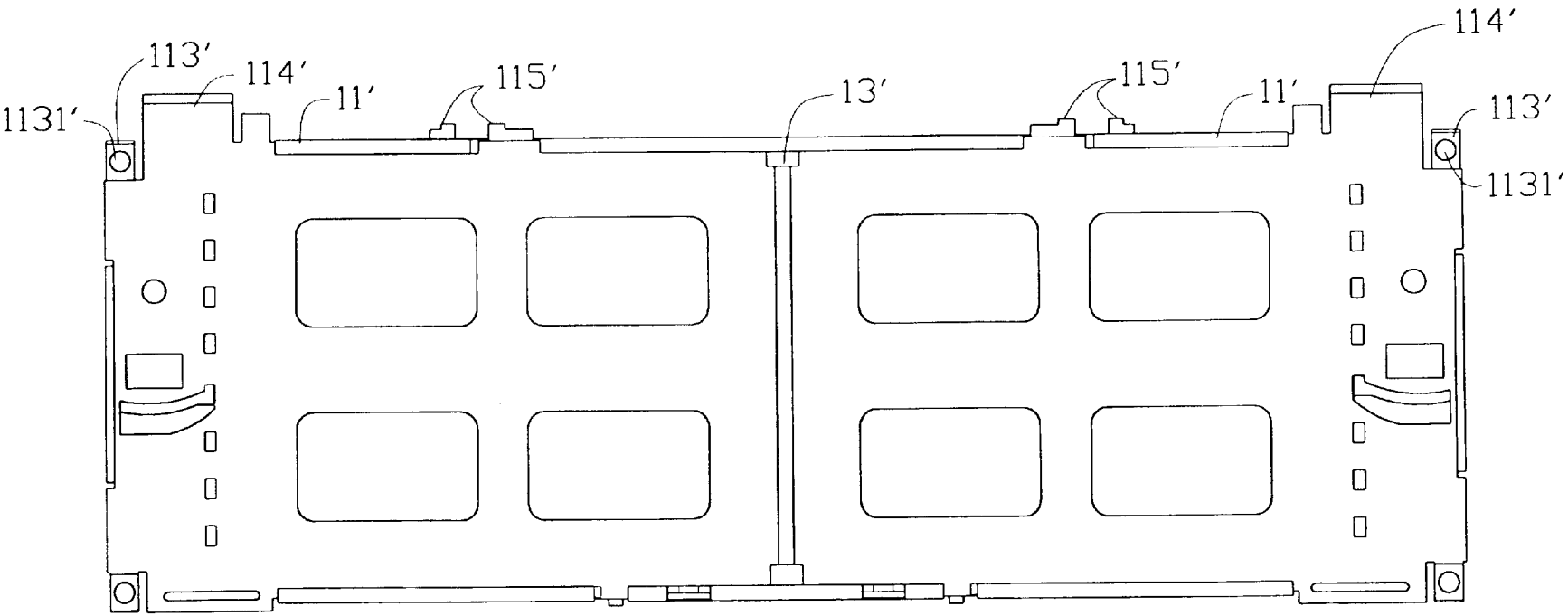
FIG. 7A is a top plan view of integrally formed upper and lower shields in accordance with a second embodiment of the present invention.
Figure 7C:
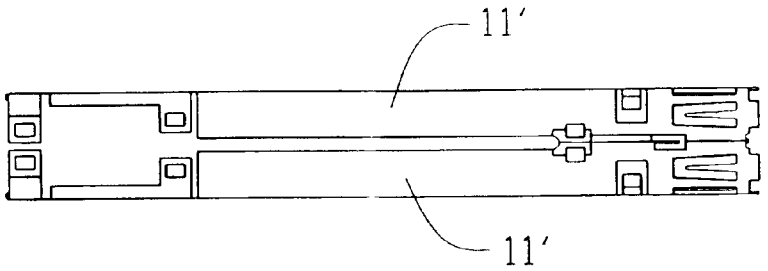
FIG. 7C is an assembled view of FIG. 7B.
Figure 7B:
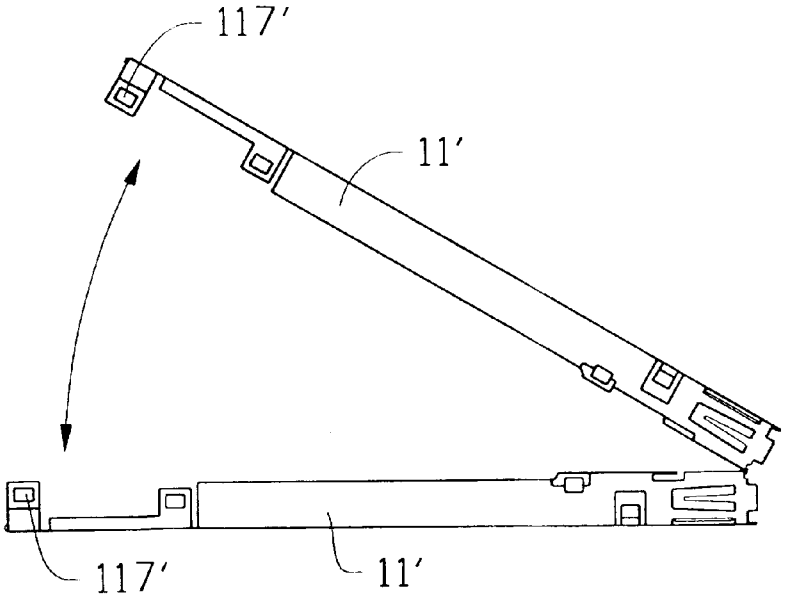
FIG. 7B is a side view showing the assembly process of the upper and lower shields.
Figure 8:
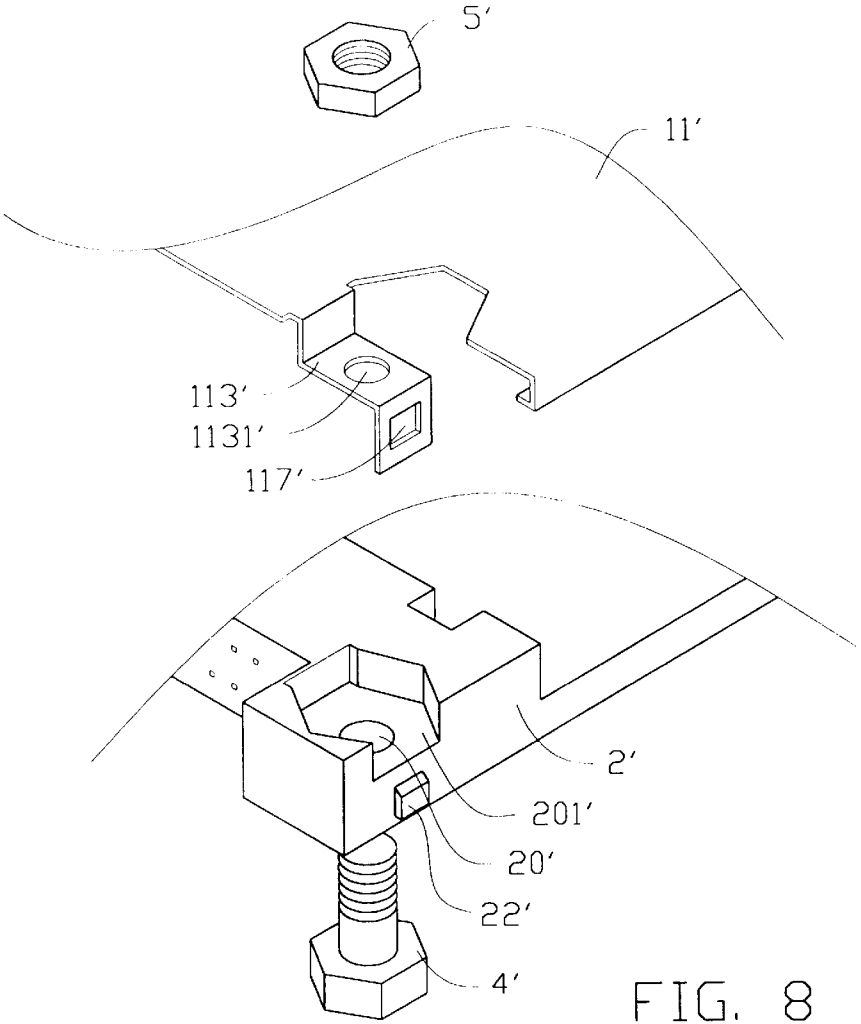
FIG. 8 is a partial, exploded view of a header, the shields, and an assembly for mounting the connector to a circuit board.

Referring to FIGS. 7A, 7B, and 7C, the structure of upper and lower shields 11' in accordance with a second embodiment of the present invention is similar to that of the first embodiment. However, the upper and lower shields 11' are integrally formed by stamping with a foldable connecting section 13' formed therebetween. Referring also to FIG. 8, a pair of clips 113' extends from opposite longitudinal side walls of the shield 11'. Each clip 113' comprises two perpendicular plates with an aperture 1131' disposed on the horizontal plate and a square opening 117' disposed on the vertical plate. A pair of tabs 22' is formed on outer sides of a header 2' for engaging with the corresponding pair of the square openings 117'. The other components are identical to those of the first embodiment, thus a detailed description thereof is omitted herein. In assembly, the foldable connecting section 13' is bent and pressed, each header 2 is positioned in the corresponding shield 11' away from the foldable connecting section 13', and the assembly is fastened together by means of bolts and nuts 4', 5'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector for receiving two electrical cards, comprising:

a shielding housing having upper and lower shields interconnected together at a first end thereof, each shield having a pair of flanges inwardly extending along opposite side walls thereof to define two receiving spaces in the housing;

a card ejection mechanism mounted to each of the upper and lower shields; and a header connected to each of the upper and lower shields, each header defining a plurality of passageways for receiving contacts therein, the headers being fastened together between the upper and lower shields at a second end of the shielding housing opposite the first end;

wherein one flange of each shield has a hook and the other flange has a planar portion; and the hook on one shield opposes and is engaged with the planar portion of the other shield;

wherein each card ejection mechanism comprises a pair of claws formed thereon for engaging with a corresponding pair of locking holes of the respective shield.

2. The stacked electrical card connector as described in claim 1, wherein the upper and lower shields are integrally formed.

3. The stacked electrical card connector as described in claim 1, wherein a pair of clips extends from each shield for receiving a pair of nut and having an aperture disposed in each clip.

4. The stacked electrical card connector as described in claim 3, wherein each clip is U-shaped and the aperture is disposed on a base plate thereof.

5. The stacked electrical card connector as described in claim 3, wherein:

each clip comprises two perpendicular plates; and the aperture is disposed on a horizontal one of said plates and a square opening is disposed on a vertical one of said plates for engaging with a corresponding tab of the respective header.

6. The stacked electrical card connector as described in claim 3, wherein a pair of screw holes is disposed in opposite ends of each header corresponding to the apertures of the clips for extension of a bolt therethrough.

7. The stacked electrical card connector as described in claim 6, wherein a pair of cavities is disposed in opposite ends of the header in communication with the screw holes for receiving the corresponding clips of the shields therein.

8. The stacked electrical card connector as described in claim 1, wherein an arcuate slot is disposed proximate a middle portion of each shield, and a concave plane is formed adjacent to an edge of the arcuate slot opposite the card ejection mechanism for limiting movement thereof.

9. The stacked electrical card connector as described in claim 3, wherein an L-shaped tab extends from one of the side walls of each shield proximate each clip thereby defining a space for receiving the card ejection mechanism.

* * * * *